US007568745B2

(12) United States Patent
Brose et al.

(10) Patent No.: US 7,568,745 B2
(45) **Date of Patent: *Aug. 4, 2009**

(54) STRIKER DRIVING ASSEMBLY FOR A MOTOR VEHICLE DOOR LOCK

(75) Inventors: Simon Brose, Hattingen (DE); Uwe Haarmann, Remscheid (DE); Sascha Heck, Wuppertal (DE); Anna-Maria Tanis Sanzo, Wuppertal (DE)

(73) Assignee: Brose Schliesssysteme GmbH & Co. KG, Wuppertal (DE)

( * ) Notice: Subject to any disclaimer, the term of this patent is extended or adjusted under 35 U.S.C. 154(b) by 0 days.

This patent is subject to a terminal disclaimer.

(21) Appl. No.: 12/030,547

(22) Filed: Feb. 13, 2008

(65) Prior Publication Data

US 2008/0211241 A1 Sep. 4, 2008

Related U.S. Application Data

(63) Continuation of application No. 11/022,948, filed on Dec. 28, 2004, now Pat. No. 7,341,292.

(30) Foreign Application Priority Data

Dec. 30, 2003 (DE) ..... 103 61 843

(51) Int. Cl.
*E05B 15/02* (2006.01)

(52) U.S. Cl. ..... 292/341.15; 292/341.16

(58) Field of Classification Search ..... 292/341.15, 292/341.16 X, DIG. 7, DIG. 55, 340, 144, 292/DIG. 24, DIG. 26, 341.18, 341.19, 137, 292/150

See application file for complete search history.

(56) References Cited

U.S. PATENT DOCUMENTS

| | | | |
|---|---|---|---|
| 4,707,007 | A | 11/1987 | Inoh |
| 4,889,371 | A | 12/1989 | Girard et al. |
| 4,982,984 | A | 1/1991 | Yokota et al. |
| 5,711,610 | A | 1/1998 | Deck |
| 5,755,468 | A | 5/1998 | Buchanan, Jr. |
| 5,938,254 | A | 8/1999 | Weyerstall |
| 6,045,559 | A | 4/2000 | Sueyoshi et al. |
| 6,127,913 | A | 10/2000 | Niino et al. |

(Continued)

FOREIGN PATENT DOCUMENTS

| | | |
|---|---|---|
| EP | 0 940 531 A1 | 9/1999 |

*Primary Examiner*—Patriica Engle
*Assistant Examiner*—Mark Williams
(74) *Attorney, Agent, or Firm*—David S. Safran; Roberts Mlotkowski Safran & Cole, P.C.

(57) ABSTRACT

A striker driving assembly for a motor vehicle lock that includes a striker carrier, a striker located on the striker carrier, two cams and a driving means. The striker carrier and the striker can be moved linearly by means of the cams from a pre-locking position into a main locking position. The driving means is controlled by a control which is located in the motor vehicle or on the driving assembly. The driving means also has a motor and gearing, where the cams are driven by the motor, and the application of force by the two cams to the striker carrier takes place on opposite sides of a linear axis of movement of the striker so as to move the striker carrier and striker along the linear axis of movement.

19 Claims, 6 Drawing Sheets

U.S. PATENT DOCUMENTS 6,347,020 B1 2/2002 Carpenter et al.
6,581,990 B1 6/2003 Menke et al.
6,666,487 B2 12/2003 Oxley et al.
6,715,808 B2 * 4/2004 Oxley et al. ..... 292/341.16
7,341,292 B2 * 3/2008 Brose et al. ..... 292/341.15

* cited by examiner

STRIKER DRIVING ASSEMBLY FOR A MOTOR VEHICLE DOOR LOCK

CROSS-REFERENCE TO RELATED APPLICATION

This application is a continuation of U.S. patent application Ser. No. 11/022,948, filed Dec. 28, 2004.

BACKGROUND OF THE INVENTION

1. Field of the Invention

The present invention is directed to a striker driving assembly for a motor vehicle door lock.

2. Description of Related Art

Motor vehicle door locks having a motorized locking aid to increase ease of operation are known. Motorized locking aids are used, for example, for rear hatch locks, tailgate locks, and occasionally for locks of motor vehicle side doors.

Motor vehicle door locks are known in which the motorized locking aid is associated with the latch. A striker, in these motor vehicle door locks, is located securely on the component of the body opposite the latch (for example, a B pillar, a C pillar or the rear frame). The striker is used as the abutment for the latch, and by the motorized movement of the striker from a prelocking position into a main locking position, the motor vehicle door or hatch is shut tight.

The arrangement of the motorized locking aid on the latch, and thus on the motor vehicle door, can lead to construction problems. However, the problems can be solved by assigning the motorized locking aid to the striker. To do this, a striker driving assembly on or in the corresponding component of the body (for example, the B pillar, the C pillar or the rear frame) is employed. In this way, different advantages are achieved. For example, the independence of the actuating mechanism and the central locking system of the motor vehicle door lock from the driving means of the locking aid, is achieved. The possibility of emergency opening, which is necessary for safety reasons, is implemented since the actuation mechanism remains active for actuation by hand, with respect to the latch. It is not necessary to bypass the driving means for emergency opening by structural measures.

The basis for the invention resides a striker driving assembly with a striker carrier arranged to move linearly (as shown in U.S. Pat. No. 5,938,254 which corresponds to DE 197 37 996 A1). First of all, the striker located on the striker carrier is detachably and interchangeably arranged. The striker can be a wedge-shaped striker, a locking clamp, a locking pin or the like. The striker driving assembly can thus be used in a versatile manner for any motor vehicle type.

In known striker driving assemblies, the striker carrier is connected to a driving means which comprises an electric drive motor and gearing. In addition to the electric drive motor, other drive motors can also be used, such as hydraulic or pneumatic motors. The gearing can be a worm gear, toothed gearing, or the like. The striker carrier is arranged in a housing that allows for linear movement and the driving means is permanently joined to the housing.

The striker carrier, and thus, the striker, can be moved from a prelocking position into the main locking position using a cam. The pre-locking position is the position into which the striker is moved by manual locking of the corresponding component, such as a door. In the pre-locking position, the striker is held by the latch. The corresponding component is closed in this position, and a seal which is located on the body is not completely compressed so that, in particular, driving noise within the motor vehicle sounds loud. The main locking position is the position into which the striker can be moved out of the prelocking position. The seal is compressed in this position, between the body and the corresponding component of the motor vehicle.

A cam, by which the striker can be moved, is driven by the above-described driving means. The cam fits into a receiver which is located in the middle on the striker carrier. On the edge of the receiver, in the striker carrier, a power transmission surface is formed against which the cam comes to rest (with little friction), transferring force. The receiver is shaped such that the striker carrier can be moved by means of the cam from the prelocking position into the main locking position. In addition, the known striker driving assembly has a manual actuating means so that the striker can be moved from the prelocking position into the main locking position and fixed, even when the driving means fails.

The disadvantage of this prior art device is that the location of the cam drive is fixed by the cam, which is located in the middle in the striker carrier. For a narrow installation space, matching of the striker driving assembly to the existing space is not possible. Moreover, the point of application of force of the cam on the striker carrier during operation migrates sideways. In this way, the counterforce, which has been applied by the seal at the point of application of the force of the cam, is not permanently directed in the direction which is exactly opposite the application of force of the cam. This leads to nonuniform loading and increased wear.

SUMMARY OF THE INVENTION

A primary object of this invention is to devise a striker driving assembly in which the location of the cam drive is not structurally fixed. In addition, a counterforce opposite the application of force of the cam will be able to be directed permanently in the direction which is exactly opposite the application of the force.

The aforementioned object is achieved in a striker driving assembly for a motor vehicle lock that includes a striker carrier, a striker located on the striker carrier two cams and a driving means. The striker carrier and the striker can be moved by means of the cams linearly from a pre-locking position into a main locking position. The driving means is controlled by a control which is located in the motor vehicle or on the driving assembly. The driving means further comprises a motor and gearing, where the cams are driven by the motor, and the application of force by the two cams to the striker carrier takes place symmetrically to the axis of movement of the striker.

An underlying object of the invention is to provide two cams on the striker driving assembly which act on the striker carrier. The two cams are arranged such that the application of force resulting from the two cams on the striker carrier takes place symmetrically to the axis of movement of the striker. Since, for linear movement of the striker, simply a symmetrical arrangement of the cams is necessary, the location of the cams, and thus, the location of the cam drives, are not further fixed. The configuration can proceed depending on the existing installation space. At the same time, the symmetrical arrangement of the cams results in that direction of the application of force to the striker carrier is constant. With a corresponding structure of the seal and striker driving assembly, the counterforce which has been applied by the seal is always directed opposite to the resulting application of force of the cams, so that nonuniform loading is absent. Finally, the arrangement with two cams is advantageous in that the force, acting from the latch on the striker, is distributed among the two cams. Thus, the individual cams can be designed to be relatively weak without having to lose driving power. This applies not only to the motorized shutting, but also to manual slamming of the door of the motor vehicle.

It is also advantageous if the application of force of the two cams does not take place directly on the striker carrier, but instead on the clutch plate located on the striker carrier. When the clutch plate is supported so as to be able to swivel on the striker carrier, the starting tolerance of the cams can be equalized. As a result, the gears assigned to the cams for driving need not be matched so accurately and production is simplified and costs are reduced.

Another advantage of the present invention is exhibited when the eccentric pins fit into the oblong holes of the clutch plate and are arranged substantially transverse to the axis of motion of the striker. In this way, it is possible to move the striker carrier and the striker by means of the cams, both from the prelocking position into the main locking position and also from the main locking position back into the prelocking position. A spring which pretensions the striker in the prelocking position so that it is pushed again into the prelocking position after the cams move away, need not be employed.

It is especially advantageous to make the gearing self-locking. While the cams keep their dead center position themselves, under unfavorable circumstances a strong jolt however can lead to movement of the striker carrier from the main locking position into the prelocking position. This danger is reduced by self-locking gearing.

Furthermore, the use of microswitches for controlling the driving means and its arrangement on the cams is advantageous. The microswitches are arranged so that they detect the position of the cams and transmit a corresponding signal to the control. The cams can thus be controlled by their reliably reaching their dead center position.

In another advantageous configuration, the gearing has an overload safeguard, for example a friction clutch, in order to prevent pinching of the limbs of individuals or of articles. For this purpose, there can also be a sensor which detects an unusually high closing force. When such an unusually high closing force occurs the driving means is then automatically turned off.

Other aspects, features, objectives, and advantages of this invention are explained in detail below using the accompanying drawings of preferred embodiments.

DETAILED DESCRIPTION OF THE INVENTION

Figure 1:
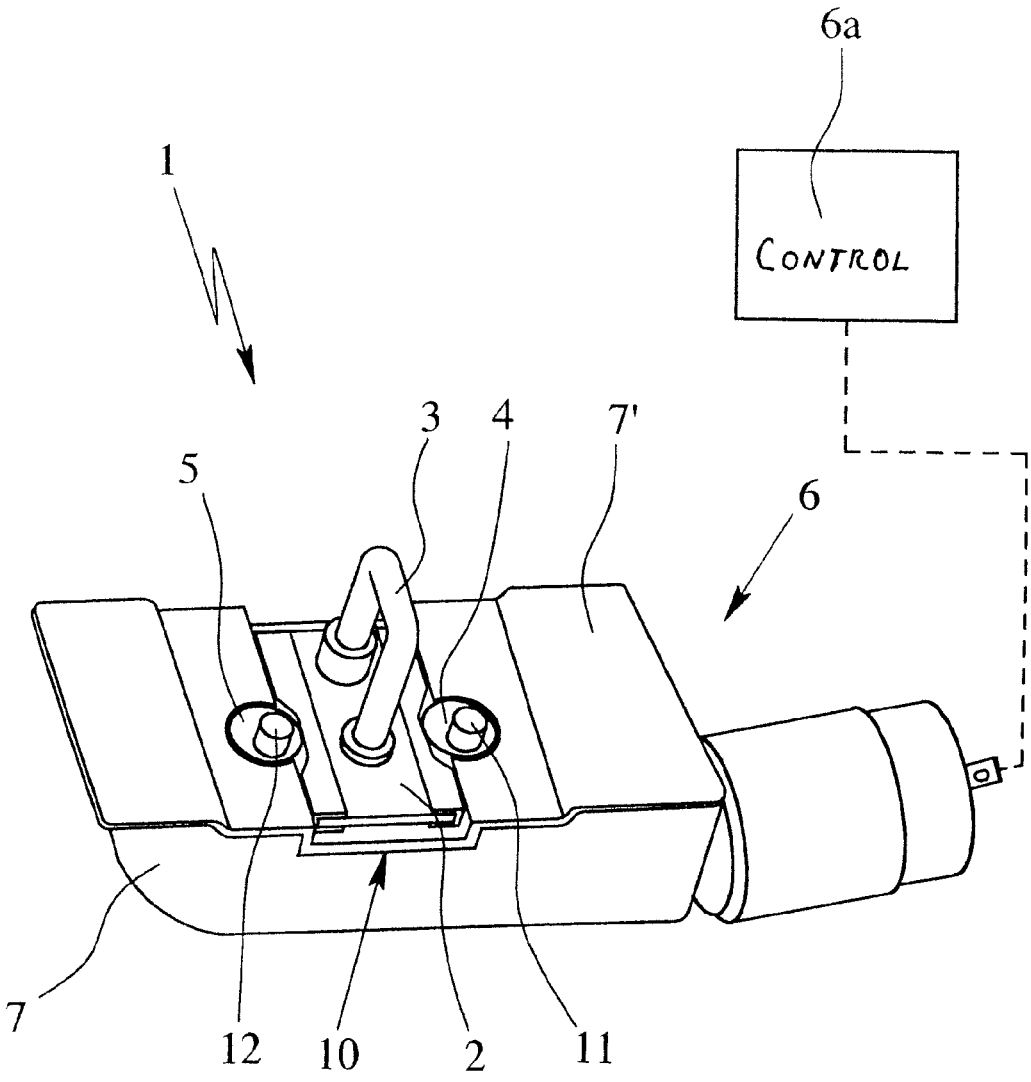
FIG. 1 shows a striker driving assembly in accordance with an exemplary embodiment of the invention.

FIG. 1 shows a striker driving assembly 1 for a motor vehicle lock with a striker carrier 2, a striker 3, two cams 4, 5 and a driving means 6. The striker 3 is preferably mounted detachably on the striker carrier 2, for example, by means of a screw. The striker 3 can, however, also be captively mounted on the striker carrier 2, for example via a weld connection, or can be connected to it in other similar manners. In the embodiment shown in FIG. 1, the striker 3 is made as a locking clip. The striker 3, however, can also be made as a locking pin, wedge-shaped striker, or the like. For a detachable connection, it is possible to replace the striker 3 and to match the striker driving assembly 1 to the requirements of other applications. The striker driving assembly 1 of the present invention is versatile in this way.

The striker carrier 2 can be linearly moved by means of two cams 4, 5, from a prelocking position into a main locking position. In the embodiment shown, the cams 4, 5 are located both in the prelocking position and also in the main locking position in one of their dead center positions. To reach the main locking position of the striker carrier 2 and the striker 3, the cams 4, 5 can be driven by a motor by the driving means 6.

The striker driving assembly 1 includes a housing 7. In the embodiment shown, in FIG. 1, the striker carrier 2 is located on the top of the housing 7 of the striker driving assembly 1. However, the striker carrier 2 can also be located in the housing 7. Alternatively, a housing 7 does not need to be included in the striker driving assembly.

When the striker carrier 2 is located in the housing 7, it is necessary for the striker carrier 2 to be supported to allow for linear movement in the housing 7. For this purpose additional bearing components are necessary or the housing 7 must be shaped accordingly within. The housing 7 can also be completely removed when, for example, the striker driving assembly 1 is installed in the body of the motor vehicle such that the corresponding body part forms the housing 7. This can be the case, for example, when the striker driving assembly 1 is used for a rear hatch closure, and is installed in the rear frame.

Figure 2:
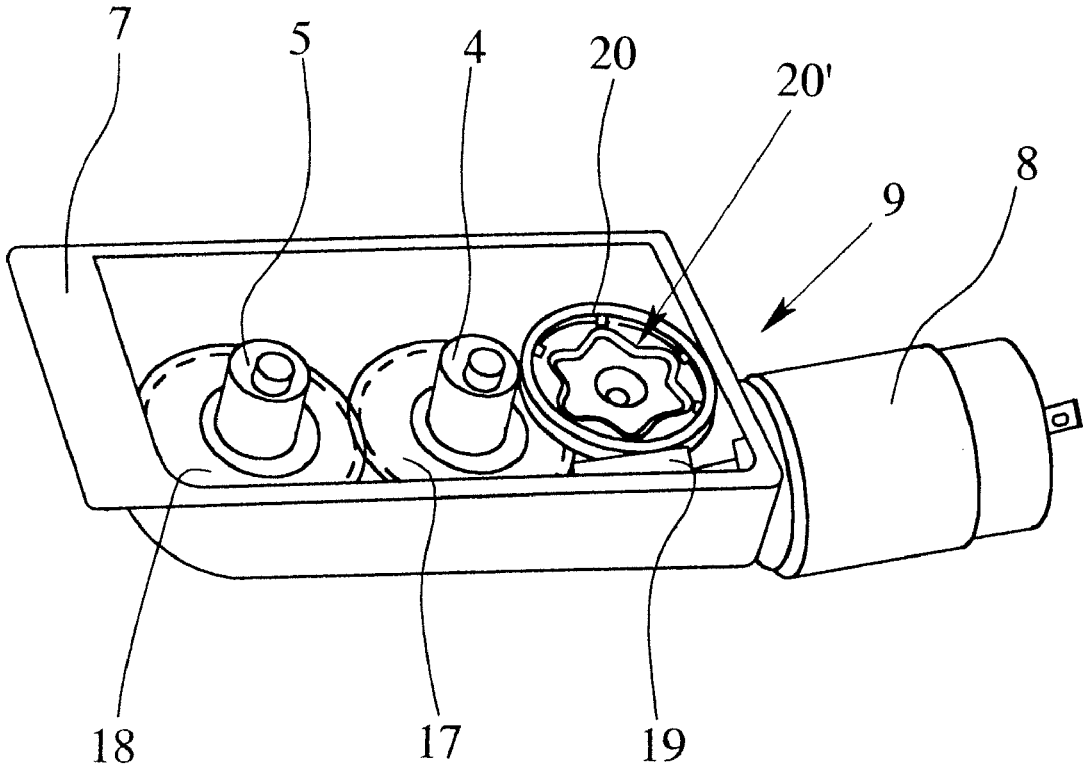
FIG. 2 shows a view of the interior of the housing of the striker driving assembly from FIG. 1.

The aforementioned driving means 6 includes a motor 8 and gearing 9, as shown in FIG. 2. The motor 8, in accordance with the present embodiment, is preferably an electric motor. However, other motors 8 such as a hydraulic or pneumatic motors can also be used. The gearing 9 can be a worm gear, toothed gearing, or the like. The specific configuration of the gearing 9 in the embodiment shown in FIG. 2 is explained below.

The driving means 6 can be controlled by a control **6*a* illustrated in FIG. 1. The control 6*a* can be located centrally in the motor vehicle and can control one or more striker driving assemblies 1, and possibly other vehicle devices. However, the control 6*a* for the driving assembly 6 can also be located decentralized in the motor vehicle (e.g., directly on the driving assembly 6). In the present embodiment, the control 6*a* controls only the corresponding driving assembly 6**.

Figure 3:
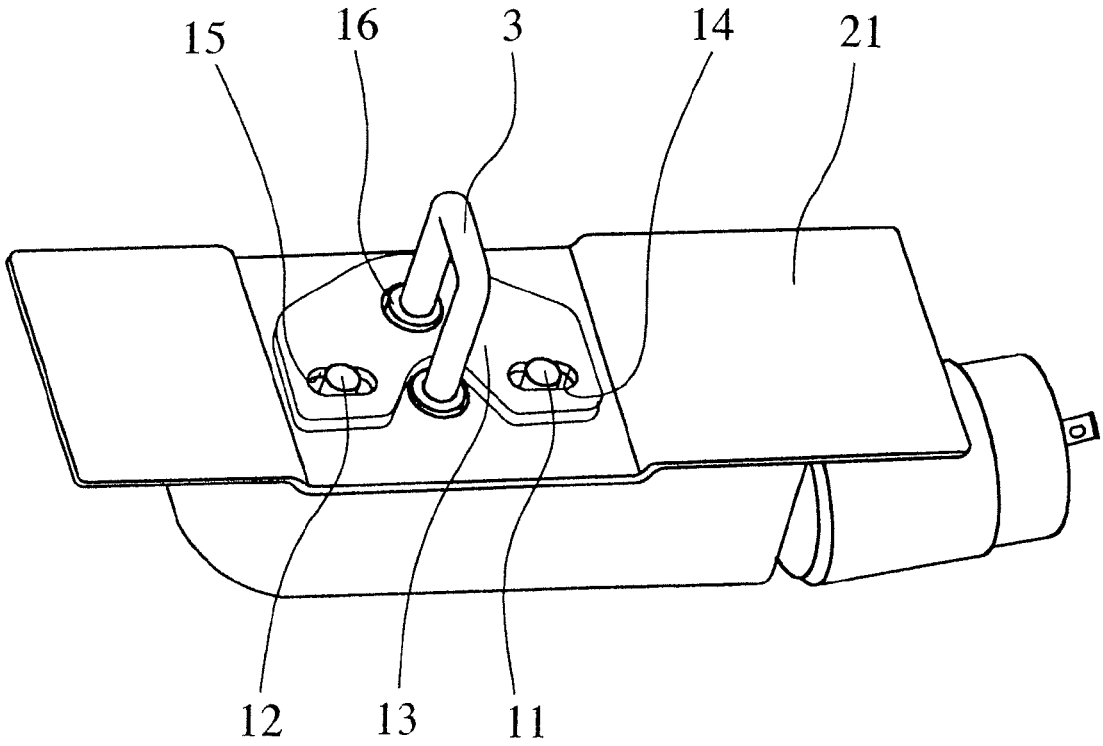
FIG. 3 shows an overhead view of the important mechanical elements of the striker driving assembly in the prelocking position.

The movement of the striker carrier 2 and thus the striker 3, takes place linearly from the prelocking position, illustrated in FIG. 3, into the main locking position. For linear movement of the striker carrier 3, it is necessary for the application of force by the two cams 4, 5 to the striker carrier 2 to take place symmetrically to the axis of movement of the striker 3. The application of force can take place directly or indirectly on the striker carrier 2, as is detailed below. While the symmetrical application of force of the two cams 4, 5 is sufficient for the linear displacement of the striker carrier 2, there is also a sliding guide 10 associated with the striker carrier 2. The sliding guide 10 prevents the striker carrier 2 from breaking out of the linear displacement motion, even in case of an impact, or the like.

The sliding guide 10 is preferably formed by the upper part 7' of the housing 7 as shown in FIG. 1. There is, therefore, a depression in the upper part 7' of the housing. This depression forms the sliding guide 10. This configuration eliminates the necessity of using other components for the sliding guide 10 and means that the striker carrier 2 is located on the top of the housing 7.

In order to achieve linear displacement of the striker carrier 2, and thus the striker 2, it is necessary for the rotary motion of the cams 4, 5 to be converted into translational motion of the striker carrier 2. This can take place by the striker carrier 2 for the eccentric pin 11, 12 of each cam 4, 5 having an oblong hole, as shown and discussed with regard to FIG. 6 below.

Each oblong hole is located substantially transverse to the axis of motion of the striker 3. The eccentric pins 11, 12 fit into the respective oblong holes of the striker carrier 2.

Another version of a striker driving assembly (not shown, but similar to U.S. Pat. No. 5,938,254, which is hereby incorporated by reference in its entirety) is made such that the striker carrier 2 has a receiver for the eccentric pins 11, 12 of each cam 4, 5 and the eccentric pins 11, 12 fit into the respective receivers (or a common receiver) of the striker carrier 2. The receivers are shaped such that the striker carrier 2 can be moved from the prelocking position into the main locking position. This means, at the same time however, that the receivers can be open on one side. What is important is only that on the edge of the receivers, a power transmission surface is formed on which the eccentric pins 11, 12 come to rest, transmitting power. For the case in which there are receivers which are open on one side, it is necessary to assign a spring to the striker carrier 2 which pretensions the striker carrier 2 into the prelocking position. Various possibilities are known for the configuration of the spring. For example, two or more springs can also be used combined here.

The aforementioned spring pretensioning can additionally, or alternatively to the aforementioned reset function, have the function of laterally align the striker carrier 2 or equalize tolerances. Basically, spring pretensioning can also be provided for any other embodiment of a driving assembly.

Another version for conversion of the displacement motion of the striker carrier 2 is shown in the preferred embodiment illustrated in FIG. 3. The cams 4, 5 act indirectly on the striker carrier 2. A clutch plate 13 is located on the striker carrier 2 such that the application of the force of the two eccentric pins 11, 12 directly to the clutch plate 13 takes place and is transferred from the clutch plate 13 to the striker carrier 2. The clutch plate 13, preferably, has oblong holes 14, 15 for the eccentric pins 11, 12 of each cam 4, 5. The eccentric pins 11, 12 fit into the respective oblong holes 14, 15 of the clutch plate 13. The oblong holes 14, 15 are located substantially transverse to the axis of motion of the striker 3. It is important that the oblong holes 14, 15 are arranged such that the force of the eccentric pins 11, 12 is transferred symmetrically to the clutch plate 13 and that, in this way, the striker carrier 2 and the striker 3 can be moved out of the prelocking position into the main locking position and out of the main locking position back into the prelocking position.

As an alternative to the oblong holes 14, 15 in the clutch plate 13, again receivers for the eccentric pins 11, 12 of each cam 4, 5 can be employed. The receivers are shaped such that the striker carrier 2 can be moved from the prelocking position into the main locking position. As previously discussed, it is not necessary for the striker carrier 2 to be movable by means of the cams 4, 5 from the main locking position into the prelocking position. Here, it is again sufficient to assign, to the striker carrier 2, a spring which pretensions the striker carrier 2 into the prelocking position. In the preferred configuration with the oblong holes 14, 15 in the clutch plate 13, the spring can be omitted in any case.

For the embodiment described with the clutch plate 13 it is necessary, if the striker carrier 2 is located between the cams 4, 5 and the clutch plate 13, that in the striker carrier 2 there are recesses for the cams 4, 5. The recesses are shaped and arranged such that the eccentric pins 11, 12 can extend into the receivers and oblong holes 14, 15 of the clutch plate 13. Moreover, the eccentric pins 11, 12 should not be hindered in their movement, by the recesses. The recesses can be formed entirely by the oblong holes and the receivers of the striker carrier 2. The receivers and oblong holes of the striker carrier 2 are made large enough that the eccentric pins 11, 12 no longer come to rest against the striker carrier 2 to transmit power.

The clutch plate 13 preferably has a hole, through which the projection 16 of the striker carrier 2 extends, for holding the striker 3 so that the clutch plate 13 is connected, by interlocking, to the striker carrier 2. However, instead of the projection 16 of the striker carrier 2 for accommodating the striker 3, the striker 3 itself, or a segment of the striker 3, can extend through the hole in the clutch plate 13. The specific execution depends especially on the execution of the striker 3. By the interlocking connection of the clutch plate 13 to the striker carrier 2, an additional fastener for the clutch plate 13 is not necessary. The clutch plate 13 can also be connected to the striker carrier 2 by means of other fasteners so that the two cams 4, 5 act indirectly by the clutch plate 13 on the striker carrier 2. The connection shown here, by means of the striker 3, is not necessary.

Each gear 17, 18 is assigned to a cam 4, 5. The gears 17, 18 are each supported coaxially on the cams 4, 5 by force fit, a screw connection, an adhesive connection, a weld connection, or the like. The gears 17, 18 can be driven in opposite directions by the driving means 6. The opposite driving is required for the application of force by the two cams 4, 5 to the striker carrier 2 which is symmetrical to the axis of motion of the striker 3. The gears 17, 18 can engage one another indirectly (i.e., with the interposition of other gears) as well as directly.

In the embodiment shown in FIG. 2, the gears 17, 18 directly engage one another. The gears 17, 18 and the cams 4, 5 are driven by gearing 9. The gearing 9, in the embodiment shown here, has a worm 19, a worm wheel 20 with an overload safeguard 20' made as a friction clutch, and a gear. The worm 19 is driven by the motor 8 and it is arranged so that it, in turn, drives the worm wheel 20. The gear is coupled to the friction clutch of the worm wheel 20 so that, under a normal load, it is driven by the worm wheel 20. The gear is, in turn, arranged such that it meshes with the gear 17 of the cam 4. The gear 17 of the cam 4 meshes in turn with the gear 18 of the cam 5 so that the two cams are driven by the drive unit 6. When a high load occurs, as is the case when an article is pinched in the door, the overload safeguard 20' prevents greater damage.

The gearing 9, as explained above, can be made differently. Preferably, the gearing 9 is made self-locking so that the striker carrier 2, in its main locking position, is also safeguarded by self-locking (in addition to being safeguarded by the dead center position of the two cams 4, 5).

In particular, it is advantageous if the clutch plate 13 is supported to swivel on the striker carrier 2 and, if the swiveling axis of the clutch plate 13 is arranged perpendicular to the striker carrier 2 and intersects the axis of motion of the striker 3. Starting tolerances of the cams 4, 5 by the clutch plate 13 can be equalized by the pivoted support of the clutch plate 13. Starting tolerances of the cams 4, 5 occur especially when the cams 4, 5 are driven by the same driving means 6. The starting tolerance of the cams 4, 5 is equalized by the clutch plate 13 as follows: At the start of motion, the eccentric pin 11 of the first cam 4 acts via the oblong hole 14 on the clutch plate 13. The clutch plate 13 is swiveled around its swiveling axis until the starting tolerance is equalized and the eccentric pin 12 of the second cam 5 likewise acts via the oblong hole 15 on the clutch plate 13. By equalizing the starting tolerance, it is possible to produce the cams 4, 5 and the gears 17, 18 with larger tolerances. Installations in the housing 7 can also be produced with larger tolerances. This leads to a cost reduction for the striker driving assembly 1. Overall, by the arrangement with two cams 4, 5, especially high closing forces can be implemented, the latter embodiment ensuring an optimum force distribution among the two cams 4, 5 and providing good safegauards against the improper action of a force.

In the embodiment shown here, the swiveling axis of the clutch plate 13 coincides with the axis of an upstanding leg of the striker 3. Depending on the configuration, the swiveling axis of the clutch plate 13 can also be the axis of movement of the striker 3 or for some other support of the clutch plate, or any axis which is located perpendicular to the striker carrier 2 and intersects the plane of motion of the striker 3.

Figure 4:
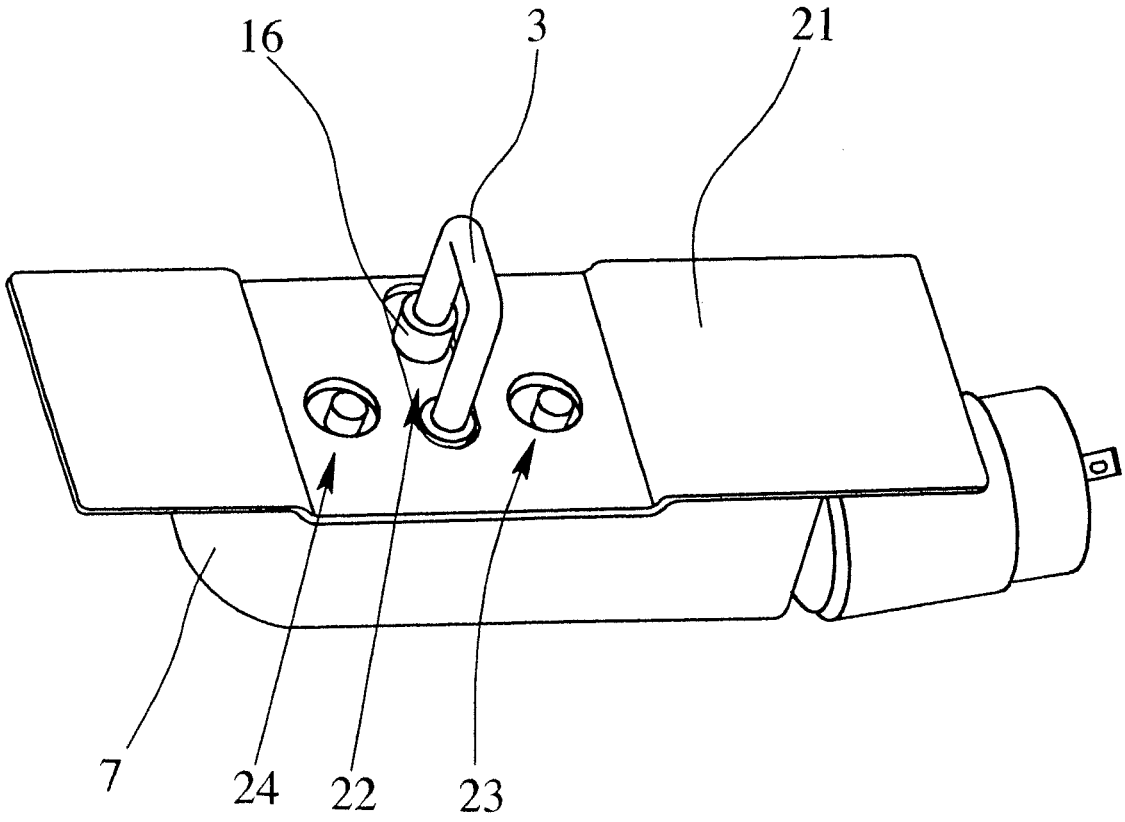
FIG. 4 shows the striker driving assembly from FIG. 3 without the clutch plate.

On the top of the housing 7, as illustrated in FIG. 4, there is preferably a mounting sheet 21. The mounting sheet 21, depending on the arrangement, has an oblong recess 22 through which the striker 3 extends. The length oblong recess 22 enables the striker 3 to be moved from the prelocking position to the main locking position. If, as in the embodiment of FIG. 3, the clutch plate 13 is located on the top of the mounting sheet 21, the mounting sheet 21 must additionally have recesses 23, 24 through which the eccentric pins 11, 12 can extend and not be hindered in their motion. The clutch plate 13 can also be located underneath the mounting sheet 21 in which the recesses 23, 24 for the eccentric pins 11, 12 are not necessary. As illustrated in FIG. 3, the mounting sheet 21 additionally has a recess in which the clutch plate 13 is located. In this way, the clutch plate 13 does not project farther than the mounting plate 21. The clutch plate 13 is then protected against dirt, etc.

The mounting sheet 21 is used for mounting the striker carrier on the corresponding components of the body, such as the B pillar, the C pillar or the rear frame of the automobile. Attachment can take place by screwing, cementing, pressing in, welding or the like. Instead of the mounting sheet 21, there can also be other fastening means, for example, directly on the housing 7.

Figure 5:
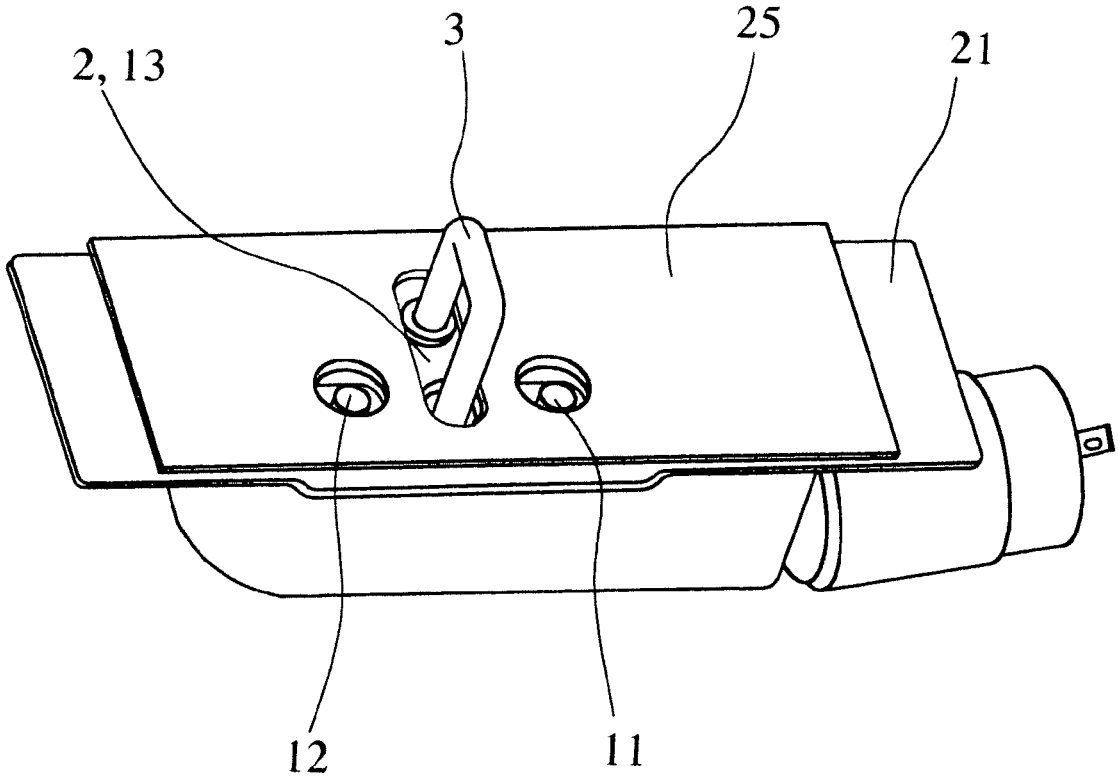
FIG. 5 shows the striker driving assembly from FIG. 3, but with an added hold-down.

As illustrated in FIG. 5, there is preferably a hold-down 25 on the top of the clutch plate 13. The hold-down 25 has at least one oblong recess for the striker 3 so that it can be moved from the prelocking position into the main locking position. Depending on the length of the eccentric pins 11, 12, the hold-down 25 also has recess for the eccentric pins 11, 12 so that they are not hindered in their movement. The hold-down 25 is used to support all the components which are located above the housing 7, especially the clutch plate 13, in the axial direction. The hold-down 25 is connected for this purpose to the mounting sheet 21, or if there is no mounting sheet 21, to the top part 7' of the housing. If there are no components above the housing 7, the hold-down 25 can be omitted. The hold-down 25 can also be omitted when the components which are located above the housing 7 are supported in the axial direction in other ways or by other means.

In the preferred embodiment, on the striker driving assembly 1 there are sensors which scan the position of the cams 4, 5 and transmit a corresponding signal to the control 6*a*. In this way, the control 6*a* can detect in what position the striker 3 is located and can trigger the motor 8 accordingly. The cams 4, 5 can thus be moved into their dead center position. The sensors can be microswitches and be located on the cams 4, 5. In this way, it becomes possible to reliably reach the dead center position of the cams 4, 5. Basically all known designs of compact sensors can be used here, for example, also Hall sensors or the like.

Within the housing 7 there can be stop buffers 2*a* for the striker carrier 2. The stop buffers 2*a* reduce the impact noise that occurs when the door is slammed and/or the noise which arises when the door is opened.

In order to reduce frictional forces, the striker carrier 2 can be supported on rollers, drums, or balls. The rollers, drums or balls, or when they are not provided, the sliding guide 10, can additionally be made from a material with a low coefficient of static friction and good sliding properties.

In addition, on the striker driving assembly 1 there can be a sensor which detects an unusually high closing force and thereupon turns off the driving means 6. This is used as a safety means in order to prevent pinching of limbs of individuals or articles. When there are articles or body parts between the door and the opposing vehicle body component, the motor cannot move the striker carrier 2 and thus the striker 3 with the otherwise conventional force from the prelocking position into the main locking position. A clearly increased force is necessary which can be detected by the sensor.

As explained above, the striker driving assembly 1 can be attached to a component of the body with fastening means. It is advantageous if the striker driving assembly 1 in the attached state can still be moved slightly relative to the body component and then can be fixed in the respective setting. This facilitates installation of the striker driving assembly 1 and simplifies production since higher tolerances can be used.

Figure 6:
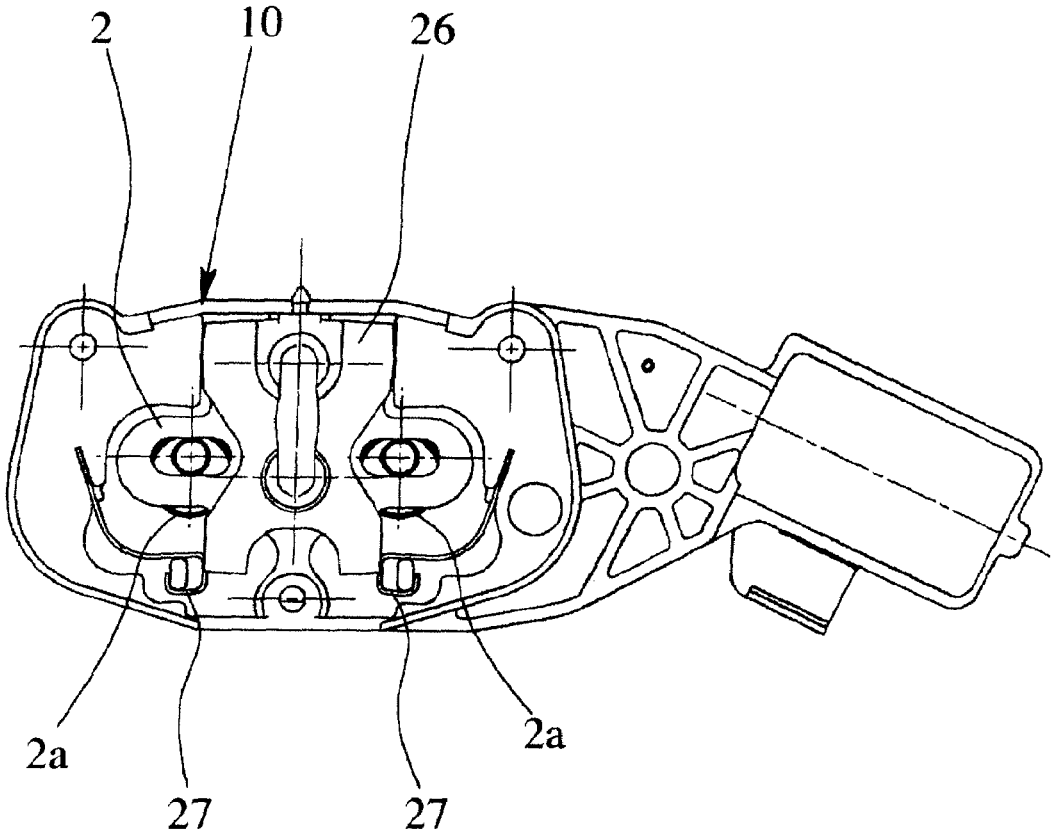
FIG. 6 shows a view of a striker driving assembly in accordance with another exemplary embodiment of the present invention.

FIG. 6 shows another embodiment of a striker driving assembly 1. The striker carrier 2 has one oblong hole each for the eccentric pins 11, 12 and is supported directly on the cams 4, 5. The striker carrier 2 is not guided directly by the sliding guide 10. Instead, on the striker carrier 2 there is a guide element 26 which is guided by the sliding guide 10 and thus ensures the linear displacement motion of the striker carrier 2. The guide element 26 can be swiveled relative to the sliding guide 10 so that the starting tolerances of the cams 4, 5 can be accommodated. In order to ensure the swiveling capacity of the guide element 26, its edges, which adjoin the sliding guide 10, are rounded. In addition, the sliding guide 10 has two spring elements 27. They act from opposing sides on the guide element 26 so that it can still be swiveled, but is reliably guided.

Finally, it should be pointed out that due to the mobility of the striker there is sealing of the arrangement such that the penetration of outside air, especially exhaust gas, via the driving assembly, into the vehicle interior, is prevented.

What is claimed is:

1. A striker driving assembly for a motor vehicle lock, comprising:

a striker carrier;

a striker located on the striker carrier, wherein the striker and the striker carrier are linearly movable along an axis of movement;

a driving means, said driving means comprising a motor and gearing;

a control for controlling the driving means; and two cams driven by the motor and disposed on opposite sides of the axis of movement and applying forces to the striker carrier at laterally opposite sides thereof for linearly moving the striker carrier and the striker along said axis of movement from a pre-locking position into a main locking position; and wherein the striker carrier includes an oblong hole for eccentric pins associated with said cams, wherein each oblong hole is located substantially transverse to the axis of motion of the striker and wherein the eccentric pins fit into the respective oblong holes of the striker carrier such that when said cams are rotated, said eccentric pins causes the cams to apply said forces to the striker carrier.

2. The driving assembly as claimed in claim 1, wherein the striker carrier is located in or on a housing and wherein the driving means is located in or on the housing.

3. The driving assembly as claimed in claim 2, wherein stop buffers are associated with the striker carrier in the housing.

4. The driving assembly as claimed in claim 2, wherein the striker carrier is supported in the housing on rollers, drums, or balls.

5. The driving assembly as claimed in claim 1, further comprising a sliding guide associated with the striker carrier.

6. The driving assembly as claimed in claim 5, wherein a top part of the housing forms the sliding guide.

7. The driving assembly as claimed in claim 6, wherein the top part of the housing comprises a depression which forms the sliding guide.

8. The driving assembly as claimed in claim 5, wherein a guide element is assigned to the striker carrier and wherein the guide element interacts with the sliding glide.

9. The driving assembly as claimed in claim 5, wherein the sliding guide comprises at least one spring element for elastic-flexible side guidance of the striker carrier or of the guide element.

10. The driving assembly as claimed in claim 1, wherein the gearing further comprising an overload safeguard.

11. The driving assembly as claimed in claim 1, further comprising:

a hold-down on the top side of the striker carrier.

12. The driving assembly as claimed in claim 1, further comprising:

a sensor which detects an unusually high closing force and thereupon turns off the driving means.

13. The driving assembly as claimed in claim 1, wherein the driving assembly is provided with fastening means for attachment to a component of the body so that, in the attached state, the driving assembly is slightly movable relative to the body component and is fixable in a respective position at which it has been set.

14. The driving assembly of claim 1, wherein a friction clutch is provided as an overload safeguard.

15. A striker driving assembly for a motor vehicle lock, comprising:

a striker carrier;

a striker located on the striker carrier, wherein the striker and the striker carrier are linearly movable along an axis of movement;

a driving means, said driving means comprising a motor and gearing;

a control for controlling the driving means; and two cams driven by the motor and disposed on opposite sides of the axis of movement and applying forces to the striker carrier at laterally opposite sides thereof for linearly moving the striker carrier and the striker along said axis of movement from a pre-locking position into a main locking position; and wherein the striker carrier further comprises receivers for eccentric pins associated with said cams, wherein the eccentric pins fit into the respective receivers of the striker carrier and wherein the receivers are shaped such that, during rotation of the cams, the striker carrier can be moved from the prelocking position into the main locking position via the cams applying said forces to the striker carrier.

16. The driving assembly as claimed in claim 15, further comprising:

a clutch plate located on the striker carrier, wherein the application of force by the eccentric pins to the striker carrier takes place by means of the clutch plate.

17. The driving assembly as claimed in claim 16, wherein the clutch plate further comprises:

oblong holes for receiving the eccentric pins of each cam, wherein each oblong hole is located substantially transverse to the axis of motion of the striker.

18. The driving assembly as claimed in claim 17, wherein the clutch plate further comprises:

a hole through which the striker, one segment of the striker or a projection of the striker carrier for holding the striker extends so that the clutch plate is connected, by interlocking, to the striker carrier.

19. The driving assembly as claimed in claim 16, wherein the clutch plate is supported to swivel on the striker carrier and wherein the swiveling axis is arranged perpendicular to the striker carrier and coincides with the axis of movement of the striker.

* * * * *